United States Patent [19]

Hartman

[11] 4,014,194

[45] Mar. 29, 1977

[54] MECHANICAL PUSH BUTTON LOCK

[76] Inventor: Susan Nilson Hartman, 20 Binnacle Hill, Oakland, Calif. 94618

[22] Filed: Jan. 7, 1976

[21] Appl. No.: 647,045

[52] U.S. Cl. ..... 70/313; 70/133; 70/315

[51] Int. Cl.[2] ..... E05B 37/16

[58] Field of Search ..... 70/214, 220, 286, 313, 70/315, 319, 119, 122, 126, 133

[56] References Cited

UNITED STATES PATENTS

| | | | |
|---|---|---|---|
| 1,185,468 | 5/1916 | Borg | 70/313 |
| 1,596,670 | 8/1926 | Linlaud | 70/305 |
| 1,613,550 | 1/1927 | Wildrick | 70/213 |
| 1,622,489 | 3/1927 | Carnes | 70/298 |
| 1,656,699 | 1/1928 | Elmwall | 70/286 |
| 1,707,523 | 4/1929 | Janer | 70/306 |
| 1,871,303 | 8/1932 | Chesick | 70/313 |
| 2,029,080 | 1/1936 | Mills | 70/214 |
| 2,665,577 | 1/1954 | Sanowskis | 70/313 X |
| 2,967,419 | 1/1961 | Katona | 70/313 |
| 3,027,743 | 4/1962 | Monahan | 70/129 |
| 3,040,556 | 6/1962 | Rosenhagen | 70/315 |
| 3,098,376 | 7/1963 | Miller | 70/333 |
| 3,379,040 | 4/1968 | Shimono | 70/313 |
| 3,412,587 | 11/1968 | Sanowskis | 70/313 |
| 3,529,454 | 9/1970 | Fish | 70/278 |
| 3,751,951 | 8/1973 | Gridley | 70/313 |
| 3,910,078 | 10/1975 | Schulz | 70/129 X |

FOREIGN PATENTS OR APPLICATIONS

| | | | |
|---|---|---|---|
| 58,917 | 5/1939 | Denmark | 70/214 |

*Primary Examiner*—Roy D. Frazier
*Assistant Examiner*—Thomas J. Holko
*Attorney, Agent, or Firm*—Warren, Chickering & Grunewald

[57] ABSTRACT

A mechanical push button lock including a lock bolt which is mechanically displaced to and from a locked position by the cooperative engagement of push button driven motion inducing means and bolt actuating means is disclosed. The motion inducing means is preferably formed as a conical element mounted to the inner end of each push button, and the bolt actuating means is preferably formed as a slide plate having a plurality of openings therein. The conical elements are skewed about their longitudinal axes so that axial advancement of the conical elements into the openings of the slide plate causes the slide plate to be preferentially displaced in a predetermined direction causing locking or unlocking of the lock mechanism. Means is also disclosed for spring biasing the push buttons and for operating the lock bolt independently of the push buttons.

5 Claims, 7 Drawing Figures

MECHANICAL PUSH BUTTON LOCK

BACKGROUND OF THE INVENTION

In recent years numerous electronic push button lock mechanisms have been marketed as an alternative to conventional key and combination locks. The push button lock eliminates the problem of the lost key and enables the user to open the lock with only one hand, which can be of great practical importance when carrying packages or the like. Such electronic push button locks, however, are often complex in structure and expensive to produce. They also depend upon an electrical source which can fail leaving the lock in either a permanently locked or unlocked position. Accordingly, attempts have been made to devise mechanical or electro-mechanical locks which incorporate at least some of the advantages of electronic push button systems.

Three mechanical lock mechanisms are shown in U.S. Pat. Nos. 3,529,454, 3,040,556, and 3,027,743. These locks each employ a push button mechanism which operates through a variety of complex mechanical linkages to open a lock bolt or similar element. While constituting some improvement over the totally electronic solutions, these electro-mechanical and purely mechanical locks are still inherently complex. In U.S. Pat. Nos. 1,596,670, 1,613,550, 1,707,523 and 3,098,376 lock mechanisms are set forth which are primarily dial-type combination locks. In addition to being complex in structure, the dial combination lock does not afford the convenience of operation which accrues from a push button lock.

Accordingly, it is an object of the present invention to provide a mechanical push button lock which has a relatively simple bolt actuating structure with a minimum of moving parts and yet provides a high degree of security.

It is another object of the present invention to provide a mechanical push button lock which is extremely durable and trouble-free in operation.

Still a further object of the present invention is to provide a mechanical push button lock in which the unlocking combination of push buttons can be easily and rapidly changed.

Still a further object of the present invention is to provide a mechanical push button lock which is inexpensive to construct and can be installed easily in existing doors.

The mechanical push button lock of the present invention has other objects and features of advantage, some of which will become apparent from the accompanying drawing or are set forth in the following detailed description.

SUMMARY OF THE INVENTION

The mechanical push button lock of the present invention includes a housing, lock bolt means mounted to the housing for movement of a bolt portion thereof to and from a locked and unlocked position, and a plurality of push button means movably mounted to the housing and formed for manual engagement from the exterior of the housing. The improvement in the lock of the present invention is comprised, briefly, of a bolt actuating portion coupled to the bolt portion and formed to transmit motion thereto, and first motion inducing means coupled to at least a first of the push buttons, with one of the first motion inducing means and the bolt actuating means being formed and mounted for cooperative engagement with each other to induce displacement of the bolt actuating portion in a direction causing the bolt to be moved toward the unlocked position. In the preferred form of the invention the motion inducing means are formed as conical elements on the ends of the push buttons, and the bolt actuating means is formed as a slide plate having a plurality of openings therein. The openings further are preferably in rows with openings in adjacent rows being longitudinally displaced or staggered. The conical elements are skewed preferentially along the longitudinal axis thereof so that engagement between the conical elements and the portion of the slide plate defining the openings causes lateral displacement of the slide plate, and accordingly the bolt, in a predetermined direction. Push button biasing means and independent bolt positioning means are also provided.

DESCRIPTION OF THE PREFERRED EMBODIMENT

Figure 1:
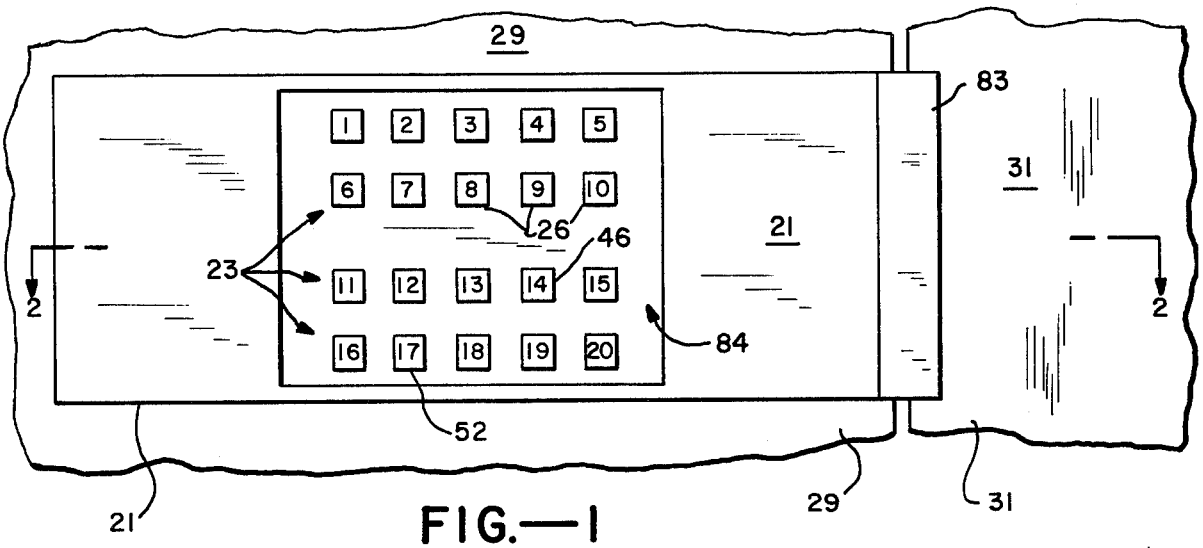
FIG. 1 is a fragmentary, front elevational view of a mechanical push button lock constructed in accordance with the present invention and mounted in a door.
Figure 2:
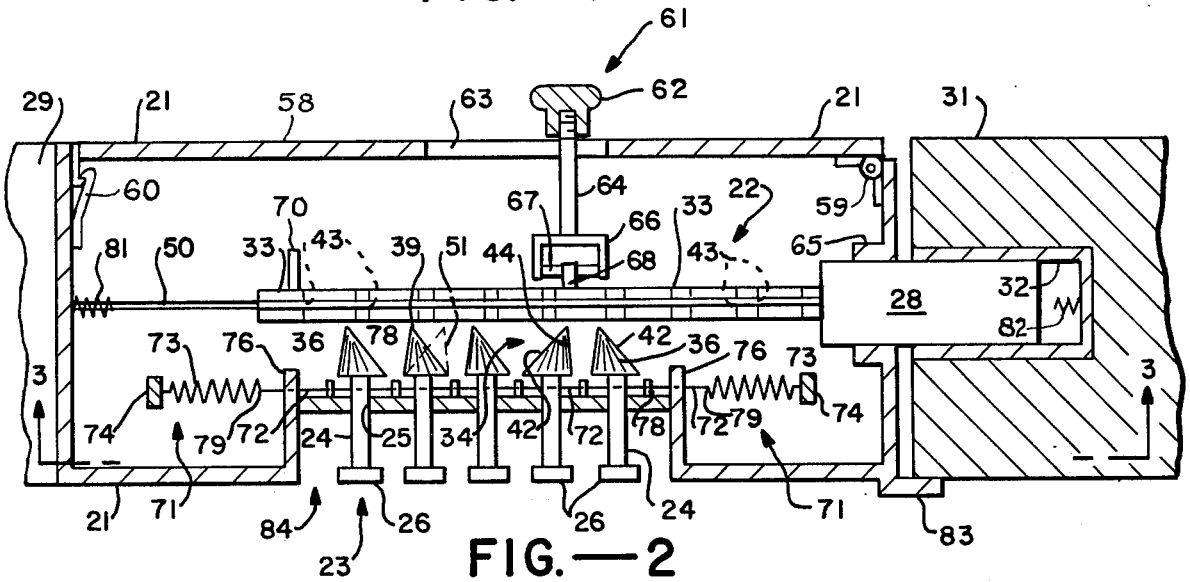
FIG. 2 is a fragmentary, cross-sectional view of the lock mechanism of FIG. 1 taken substantially along the plane of line 2—2 in FIG. 1.
Figure 3:
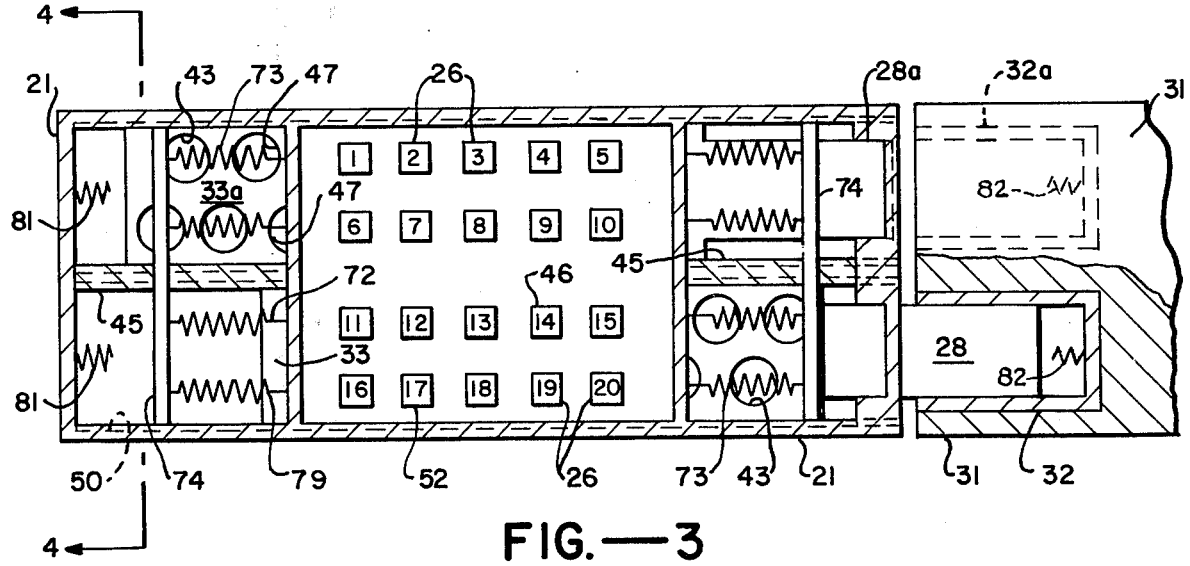
FIG. 3 is a fragmentary, cross-sectional view taken substantially along the plane of line 3—3 in FIG. 2.

Referring now to FIGS. 1, 2 and 3, the mechanical push button lock of the present invention can be seen to include a housing 21 having lock bolt means, generally designated 22, movably mounted therein and a plurality of push button means, generally designated 23, also movably mounted to housing 21. Included as a part of push button means 23 is a shaft or rod 24, which extends through opening 25 in housing 21 and terminates at the outermost end thereof in an enlarged head 26. It is preferable that rods or shafts 24 be non-circular in cross section so that they are not free to rotate about the longitudinal axes thereof. The importance of such a construction will be explained in more detail hereinafter. Opening 25 and shaft 26, however, are dimensioned for free sliding movement of the push buttons along the longitudinal axes of shafts 24.

Lock bolt means 22 includes a bolt portion 28 formed to span the distance between door 29 and door frame 31. The door frame is preferably formed with a receiver or keeper 32 dimensioned for sliding receipt of bolt 28. As will be described in greater detail hereinafter, the lock mechanism of the present invention may optionally be formed with a second, independently operable bolt 28*a* vertically superimposed over bolt 28. Mounted in door frame 31 is bolt receiver 32*a*, vertically superimposed over receiver 32.

In the improved mechanical push button lock of the present invention, lock bolt means 22 further includes a bolt actuating portion 33 which is coupled to bolt portion 28. As shown in the drawing, bolt actuating portion 33 is formed as a slide plate which is fastened at an end thereof or integrally formed with enlarged bolt portion 28. Thus, bolt actuating portion 33 and bolt portion 28 are formed for movement as a unit.

In order to provide for mechanical movement of bolt 28 from a locked to an unlocked position, motion inducing means, generally designated 34, are coupled to push button means 23, in this case by mounting directly on the inner end of shaft 24 of the push buttons. The motion inducing means 34 are formed and mounted for cooperative engagement with bolt actuating portion 33 upon inward displacement or movement of push buttons 23. The cooperative engagement of the motion inducing means with bolt actuating means causes movement of the bolt actuating means in a predetermined direction, either toward a locked or an unlocked position, depending upon the manner in which the motion inducing means is constructed or oriented. In the mechanical push button lock of the present invention, however, at least a first motion inducing means is formed for cooperative engagement of bolt actuating means in a direction causing displacement of bolt 28 from the locked position (shown in FIGS. 2 and 3 by bolt 28) to an unlocked position (shown in FIG. 3 by bolt 28*a*).

Figure 5:
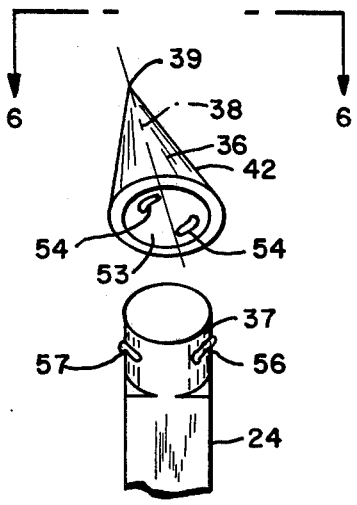
FIG. 5 is an enlarged, fragmentary, side elevational view of a push button suitable for use in the lock of the present invention.
Figure 6:
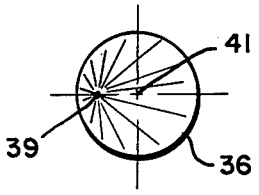
FIG. 6 is an end elevational view of the push button of FIG. 5.

As best may be seen in FIGS. 5 and 6, the motion inducing means of the present invention is preferably formed as a conical element 36 which is mounted on the end 37 of shaft 24 of the push buttons. The longitudinal axis 38 of conical element 36 is inclined or skewed from the perpendicular to the base of the cone so that the tip 39 of the cone is not superimposed over the center 41 of the base of the cone, but is laterally displaced therefrom. This construction causes the cone to have an inclined surface 42 which is employed in the mechanism of the present invention to induce lateral shifting of bolt actuator means 33.

Figure 7:
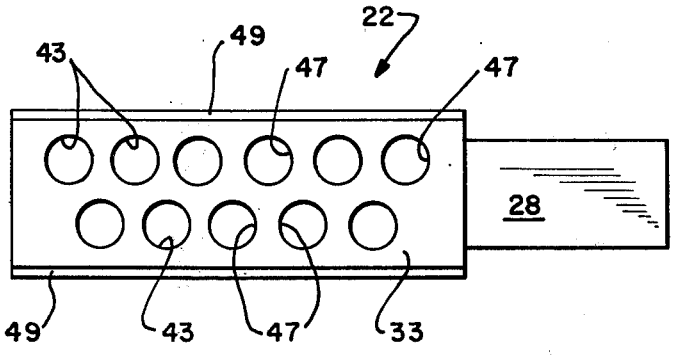
FIG. 7 is a side elevational view of a slide plate and bolt suitable for use in the lock of the present invention.

Bolt actuating means 33 can best be seen in FIG. 7 as being formed as a plate-like member having at least two rows of generally cylindrical openings 43 extending therethrough. The diameter of openings 43 is approximately equal to the diameter of the base of conical element 36. The vertical spacing of the rows of openings 43 is substantially equal to and aligned with the vertical spacing between the adjacent rows of push buttons 23.

As best may be seen in FIG. 2, the tips 39 of cones 36 are axially aligned so that they will be advanced into openings 43 upon inward displacement of a push button. A first motion inducing element 44 can be seen to be mounted to first push button 46 in a manner so that the tip 39 thereof is skewed in an opposite direction from the tips of the remainder of the motion inducing cones 36. Moreover, it will be apparent from FIG. 2, that should any one of the push buttons in the top row of buttons, other than push button 46, be inwardly depressed, the inclined surface 42 of conical elements 36 will engage a bearing surface 47, defining the lateral or side edges of openings 43. Since all of the cones, except conical element 44, are skewed with their pointed ends to the left, inward displacement of the push buttons will cause inclined surfaces 42 to shift the bolt actuating slide plate 33 to the right, causing bolt 28 to be advanced toward the locked position. If push button 46 is depressed, however, the skewed cone 44 bears upon an oppositely facing bearing surface 47 and will shift slide plate 33 and bolt 28 toward the unlocked position.

Figure 4:
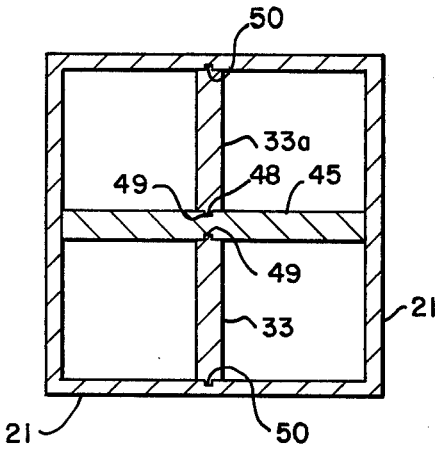
FIG. 4 is an end elevational view, in cross-section, taken substantially along the plane of line 4—4 of FIG. 3.

The mounting of slide plates 33 and 33*a* for reciprocation can be accomplished in several ways. FIG. 4 shows the use of a cross-member 45 having longitudinally extending grooves 48 therein to receive longitudinally extending tongues or ribs 49 on slide plates 33 and 33*a*. Additionally, grooves 50 are formed in the upper and lower housing walls.

In the form of the invention shown in the drawings, conical element 44 will shift slide plate 33 toward, but not completely to, the unlocked position. When push button 46 is fully depressed, plate 33 will be shifted to the left until the bearing edge 47 is displaced into alignment with the leftmost edge of the base of cone 44. Further reciprocation or pushing of button 46 will not shift bolt 28 in either direction. As best may be seen in FIGS. 3 and 7, however, slide plate 33 is formed with two rows of openings 43. The lower row of openings 43 is laterally displaced or staggered to about the midpoint between the centers of the upper openings. Thus, when one row of holes is directly behind the bases of cones 36, the holes or openings in the staggered or off-set row are positioned so that the apex 41 of a cone will just fall inside the edge of one of two side-by-side holes, depending upon which way the cone is skewed.

In order to shift bolt 28 completely from the locked to the unlocked position, a second motion inducing cone 51 (shown in phantom in FIG. 2) oriented in the same manner as cone 44 and mounted to push button 52 in the bottom row of buttons is provided. Thus, in order to open the lock completely, one must first push button 46, which shifts slide plate 33 and bolt 28 to the left only part of the distance to the unlocked position, and then depress push button 52, which cooperatively engages the staggered lower row of openings 43 in slide plate 33 and displaces lock bolt 28 further to the left toward the open position.

Depending upon the length of the conical motion inducing elements 36, the bolt 28 may be moved completely from the locked position to an unlocked position by merely depressing button 46 followed by button 52. If, however, the lateral motion induced is not enough to displace the bolt completely to the open position, one need only repeat the process several times, that is, depress button 46, then button 52, then button 46 and then button 52. The staggered openings in bolt actuating slide plate 33 together with the skewed cones on the push buttons allows the bolt to be unlocked by alternately pushing the right button in each row until enough lateral displacement of the bolt is achieved so that it is free of receiver 32.

As will be apparent, all of the remainder of the push buttons have motion inducing elements or cones mounted thereto which will tend to displace bolt 28 toward the locked position. Accordingly, should someone attempt an unauthorized opening of the lock, every time they depress a push button other than buttons 46 and 52, they would be urging the bolt toward a locked position. Moreover, merely pushing one of the buttons 46 or 52 would not be sufficient to unlock the lock, and when one of the correct buttons is pushed, and an incorrect button is then pushed, the net effect is to maintain the lock bolt in the same position.

In the lock mechanism shown in the drawings, four numbers must be known in order to open both bolts 28 and 28*a*. The unlocking process for bolt 28*a* (by means of associated slide plate 33*a*) is the same as that described in connection with bolt 28. As will be appreciated, it would be possible to further multiply the number of slide bolts and to increase the number of sets of push buttons so as to further reduce the probability of discovering the combination by trail and error.

As thus far described, the lock of the present invention is formed with a bolt actuating slide plate 33 which has uniformly spaced apart openings 43 while the motion inducing means 34 are preferentially skewed in either of two predetermined directions. It will be understood, however, that it is possible to form the present lock with motion inducing cones 34 which are not skewed or inclined and to provide slide plate 33 with openings which are irregularly spaced apart or shaped. When this approach is used, it is preferable that each push button need be depressed only once to open the lock since the slide plate will shift to juxtapose the irregular opening (the only one which shifts the bolt toward the open position) in front of a different push button.

In a similar variation the lock of the present invention can be formed with openings 43 in the adjacent rows of opening in vertically aligned relation rather than staggered or laterally displaced relation. In this construction the adjacent rows in each set of push buttons would be staggered or laterally displaced.

In order to enable the combination of push buttons which open the lock of the present invention to be changed, it is preferable that each of elements 36 be formed for selective connection to the ends 37 of the push button shafts in either of two orientations. Thus, each of conical elements 36 is formed for connection to push buttons 23 with the apex 39 skewed to the right, as is shown for elements 44 and 51, or to the left, as is shown for the remainder of the conical elements 36. FIG. 5 shows one means by which conical element 36 can be attached to push button shaft 24 in either one of two orientations. The interior surface 53 of cone 36 is formed with a pair of ribs or thread-like protrusions 54. Mating protrusions 56 and 57 are formed on the exterior of shaft 24. The mating protrusions 56 and 57 are spaced apart around the periphery of shaft 24, which is formed with a rounded end 37, so as to provide a bayonet-type of connection in which the cone can be cinched down in either of two orientations. Thus, if conical element 36 is dropped down over end 37 of the push button shaft, at a first space between protrusions 56 and 57, it can be rotated and cinched down in a first orientation. If dropped down in a second space and cinched down, the cone will be turned by 180°.

As also will be seen in FIG. 5, end 37 of shaft 24 is round while the balance of shaft 24 is rectangular. The rectangular portion of shaft 24 passes through a rectangular opening 25 in housing 21. This rectangular opening prevents rotation of shaft 24 so that the direction toward which apex 39 of conical element 36 is skewed will remain constant. Such a constant orientation of each of the conical elements is required in order to maintain the predetermined orientation necessary to establish a fixed combination.

As best may be seen in FIG. 2, the push button lock mechanism of the present invention further preferably includes positioning means, generally designated 61, movably mounted to the housing and coupled to bolt actuating means 22. Extending outwardly of housing 21 through slot 63 is a shaft 64 having manually engageable nob 62 mounted thereon. The inner end of shaft 64 is provided with a yoke 66 having a connecting rod 67 spanning thereacross. Fixedly secured to slide plate 33 is an ear 68 having U-shaped slot dimensioned for sliding receipt of connecting rod 67 therethrough.

As thus formed, the manual positioning means 61 can be used on the inside of the door to displace bolt 28 to either the locked or unlocked position. As knob 62 is reciprocated parallel to slide plate 33, the ends of yoke 66 come into engagement with ear 68 and enable the slide plate to be displaced. The yoke assembly, however, allows the slide plate to be displaced by means of push buttons 23 without movement of manual positioning means 61.

Access to conical motion inducing means 34 is afforded by mounting rear housing plate 58 to the remainder of housing 21 by hinge means 59. Mounted at the opposite end of plate 58 is a friction latch or detent 60 formed to releasably hold the plate in a closed position. In order to change the orientation of cones 36, door 29 is first opened and then plate 58 can be swung outwardly about hinge 59. As this is done, connecting rod 67 will pass outwardly from the U-shaped slot in ear 68. With door 29 held in an open position, slide plates 33 and/or 33*a* can be moved out through the bolt opening defined by housing flanges 65 until stop means 70 on the ends of the slide plates engages flanges 65. With the slide plate reciprocated out through flanges 65, access to cones 36 is readily afforded. The cones can then be twisted off their bayonet connections, rotated by 180°, and twisted back onto the ends of shafts 24 in a new orientation.

It is a further important aspect of the present invention to provide the mechanical push button lock with spring biasing means, generally designated 71, coupled to push buttons 23 and formed to bias the push buttons to the outermost position shown in FIG. 2. Included in spring biasing means 71 is a flexible tendon 72 with spring means 73 coupled thereto, preferably a pair of springs 73 mounted at the ends of tendon 72. Springs 73 are preferably tension springs fastened at their ends to cross bars 74, which are in turn secured to housing 21. Tendon 72 slidably passes through openings in inwardly projecting flanges 76 and further passes slidably through guide or restraining means 78 and openings in shafts 24 of the push buttons.

The length of flexible tendon 72 is selected so that any one push button may be fully depressed until the base of conical element 36 is proximate bearing surface edge 47 defining openings 43. When the head 26 of the push buttons is released, the tension springs 73 cause the flexible tendon to pull the push button back to its original position. As the push button is inwardly depressed, the tendon slides through flanges 76 and restraining loop element 78, as well as through the opening in the shaft 24 of the push button. Similarly, when the button is snapped back under the spring, the tendon slides in the opposite direction. It is not possible, however, to depress two push buttons at the same time into full engagement with slide plate 33 because the length of tendon 72 has been selected to prevent the simultaneous depression of more than one push button. If two push buttons are depressed at any one time, the ends 79 of springs 73 will be brought into contact with flanges 76 before both conical elements 36 on the push buttons can be engaged fully with slide plate 33. This is accomplished because of the restraining elements or loops 78 intermediate each of the push buttons requires flexible tendon 72 to be held in close proximity to the housing on both sides of each shaft 24 and to loop outwardly therefrom to pass through the opening in the push button shaft. As will also be appreciated, a single spring 73 is all that is required to provide the necessary biasing force, although a pair of springs on each end of tendon 72 has been found to be preferable.

It is also preferable to mount spring means 81 to housing 21 in a position to engage the slide plate at the end of its travel and second spring means 82 in receivers 32 and 32*a* in a position to engage the bolts. Springs 81 and 82 are compression springs which are engaged by the slide plate or bolt to prevent discovery of the combination by trial-and-error. If the plate could be advanced to a fully locked or unlocked position only two buttons would be able to move the plate, namely, the combination buttons. Springs 81 and 82 give the appearance and/or feeling of movement of plate 33 even at the end of its travel. Thus, when a button is pushed, the plate moves against the springs and when released, the springs move the plate back to its original position.

In order to further minimize the chance of an unauthorized entry, the lock of the present invention is also provided with a flange or plate 83 which visually blocks bolts 32 and 32*a*. The bolts are shifted by the motion inducing means 34 and flange 83 prevents observation of the direction in which they are displaced.

It is also optionally possible to provide the housing 21 with a front protective cover, preferably hinged at a side of the housing. Thus, push buttons 23 are shown mounted in a recess 84 of the front of housing 21 so that the heads 26 are flush with the housing front, permitting them to be covered by a cover plate, not shown. Even when no front cover is provided, positioning the push buttons in recess 84 reduces the likelihood that they will become damaged or jammed.

What is claimed is:

1. A mechanical push button lock including a housing, a lock bolt slidably mounted to said housing for reciprocation to and from a locked position and an unlocked position, a plurality of push buttons mounted to said housing and extending outwardly thereof, said push buttons each being mounted for inward displacement with respect to said housing when manually pressed, lock bolt actuating means movably mounted to said housing and coupled to said bolt for the transmission of motion thereto, and a plurality of motion inducing elements with one of said elements being connected to each of said plurality of push buttons, each of said elements being formed for cooperative engagement with said bolt actuating means upon inward displacement of said push buttons and formed to cause movement of said bolt actuating means in a direction causing movement of said bolt, wherein the improvement in said lock comprises:

each of said elements being formed as a conical member having a longitudinally skewed axis, and said bolt actuating means being formed as a plate-like member having openings formed therein for receipt of and cooperative engagement of said conical member with a bearing surface defining said opening.

2. A mechanical push button lock including a housing, a lock bolt slidably mounted to said housing for reciprocation to and from a locked position and an unlocked position, a plurality of push buttons mounted to said housing and extending outwardly thereof, said push buttons each being mounted for inward displacement with respect to said housing when manually pressed, lock bolt actuating means movably mounted to said housing and coupled to said bolt for the transmission of motion thereto, and a plurality of motion inducing elements with one of said elements being connected to each of said plurality of push buttons, each of said elements being formed for cooperative engagement with said bolt actuating means upon inward displacement of said push buttons and formed to cause movement of said bolt actuating means in a direction causing movement of said bolt, wherein the improvement in said lock comprises:

spring biasing means coupled to each of said push buttons and formed to bias said push buttons to an outermost position, said spring biasing means being further formed to prevent displacement of more than one push button at any one time.

3. A mechanical push button lock as defined in claim 2 wherein, said spring biasing means is formed as a flexible tendon slidably coupled to a plurality of push buttons and anchored to said housing, and spring means coupled to said tendon and formed to induce a resilient tension force in said tendon, and tendon restraining means slidably coupled to said tendon and secured to said housing to restrain motion of said tendon intermediate said push buttons, said tendon having a total length, as restrained by said restraining means, preventing displacement of more than one push button at any one time.

4. A mechanical push button lock including a housing, a lock bolt slidably mounted to said housing for reciprocation to and from a locked position and an unlocked position, a plurality of push buttons mounted to said housing and extending outwardly thereof, said push buttons each being mounted for inward displacement with respect to said housing when manually pressed, lock bolt actuating means movably mounted to said housing and coupled to said bolt for the transmission of motion thereto, and a plurality of motion inducing elements with one of said elements being connected to each of said plurality of push buttons, each of said elements being formed for cooperative engagement with said bolt actuating means upon inward displacement of said push buttons and formed to cause movement of said bolt actuating means in a direction causing movement of said bolt, at least two of said elements being formed for cooperative engagement with said bolt actuating means to cause movement of said bolt toward said unlocked position, and the remainder of said elements being formed to cause movement of said bolt toward said locked position, wherein the improvement in said lock comprises:

said push buttons being mounted to said housing in at least two rows with one of the elements causing movement of said bolt toward the unlocked position being positioned in each of said rows of push buttons, said bolt actuating means is formed as a slide plate having a plurality of openings formed therein, said openings being positioned in said slide plate in at least two rows, and at least one row of one of said rows of push buttons and said rows of openings being laterally displaced with respect to the remaining row to require sequential inward displacement of said push buttons to effect movement of said bolt to said unlocked position.

5. A mechanical push button lock as defined in claim wherein, said slide plate is formed with said opening in one row laterally displaced to about the mid-point between the opening in the immediately adjacent row, and said push buttons in said rows of push buttons are mounted in substantially vertically aligned relation.

* * * * *

UNITED STATES PATENT OFFICE

CERTIFICATE OF CORRECTION

Patent No. 4,014,194 Dated March 29, 1977

Inventor(s) Susan Nilson Hartman

It is certified that error appears in the above-identified patent and that said Letters Patent are hereby corrected as shown below:

Column 9, line 3, after "claim" -- 4 -- has been inserted.

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*